US005557375A

United States Patent [19]

Nagayasu et al.

[11] Patent Number: 5,557,375

[45] Date of Patent: Sep. 17, 1996

[54] CONTACT TYPE CHARGING DEVICE AND IMAGE FORMING APPARATUS HAVING THE SAME

[75] Inventors: Keiko Nagayasu, Ibaraki; Akihito Ikegawa, Sakai; Isao Doi, Toyonaka; Masashi Yamamoto, Settsu, all of Japan

[73] Assignee: Minolta Co., Ltd., Osaka, Japan

[21] Appl. No.: 513,074

[22] Filed: Aug. 9, 1995

[30] Foreign Application Priority Data

Aug. 26, 1994 [JP] Japan ..... 6-225854

[51] Int. Cl.[6] ..... G03G 15/02; G03G 21/00

[52] U.S. Cl. ..... 355/219; 355/208; 355/296; 361/225

[58] Field of Search ..... 355/219, 204, 355/208, 296; 361/225, 230

[56] References Cited

U.S. PATENT DOCUMENTS

| | | | |
|---|---|---|---|
| 5,068,762 | 11/1991 | Yoshihara | 361/225 |
| 5,126,913 | 6/1992 | Araya et al. | 361/225 |
| 5,192,974 | 3/1993 | Ikegawa et al. | 355/219 |
| 5,278,614 | 1/1994 | Ikegaga et al. | 355/219 |
| 5,321,472 | 6/1994 | Adachi et al. | 355/219 |
| 5,323,215 | 6/1994 | Ohtaka et al. | 355/269 |
| 5,353,101 | 10/1994 | Adachi et al. | 355/219 |
| 5,357,322 | 10/1994 | Hoshika | 355/219 |
| 5,376,995 | 12/1994 | Yamamoto et al. | 355/219 |
| 5,402,213 | 3/1995 | Ikegawa et al. | 355/219 |
| 5,475,471 | 12/1995 | Kisu et al. | 355/219 |

FOREIGN PATENT DOCUMENTS

| | | | |
|---|---|---|---|
| 2-282279 | 11/1990 | Japan | 355/219 |
| 4-260068 | 9/1992 | Japan | 355/219 |
| 5-66651 | 3/1993 | Japan | 355/219 |
| 5-100546 | 4/1993 | Japan | 355/219 |
| 5-241422 | 9/1993 | Japan | 355/219 |
| 6-138748 | 5/1994 | Japan | 355/219 |

*Primary Examiner*—R. L. Moses
*Attorney, Agent, or Firm*—Brinks Hofer Gilson & Lione

[57] ABSTRACT

An image forming apparatus that includes a positioning device for selectively positioning a contact-charging member at a charging position where the contact-charging member contacts a photosensitive carrier at a first region or at a cleaning position where the contact-charging member contacts the carrier at a second region. A contact charger apparatus for charging a carrier for carrying an electrostatic latent image, said contact charger apparatus that includes a voltage source coupled to a contact charger for applying a voltage to said carrier; and a contact charger cleaner for changing a contact area between said contact charger and said carrier to effect cleaning of said contact charger.

19 Claims, 8 Drawing Sheets

CONTACT TYPE CHARGING DEVICE AND IMAGE FORMING APPARATUS HAVING THE SAME

FIELD OF THE INVENTION

The present invention relates to an image forming apparatus, and more particularly, to a contact charger for use with image forming apparatus, such as electrophotographic copiers, printers and the like.

BACKGROUND OF THE INVENTION

In image forming apparatus, such as electrophotographic copiers, printers and the like, the surface of a latent image carrying member, such as a photosensitive drum or the like, is charged by a charger. An electrostatic latent image is formed on the charged region by an image exposure, and the latent image is developed so as to be rendered visible. The developed image is transferred onto a transfer member, and fixed on the transfer member.

Various types of chargers are commonly known, and these can be broadly divided into corona chargers and contact chargers. Corona chargers use a corona discharge to form the electrostatic latent image on the surface of an electrostatic latent image carrying member, whereas contact chargers include a charging brush, charging roller or rotatably driven endless charging belt which is brought into contact with the surface of an electrostatic latent image carrying member.

Chargers using a corona discharge are advantageous in that they provide stable charging, but are disadvantageous insofar as they generate large amounts of ozone which cause deterioration of the latent image carrying member and is harmful to humans. Contact chargers, however, generate markedly less ozone than corona chargers.

Among contact chargers, those using drive type rollers and belt have complex constructions due to the necessity of a means to implement the drive. Stationary type contact chargers which use a blade or film as a contact member for charging are advantageous inasmuch as they are inexpensive and compact.

An example of such a blade type contact charger is shown in FIG. 16. This type of charger is provided with a blade B as a contact member which makes contact at a predetermined position with the surface of a charge-receiving member N, such as a photosensitive member or the like, in at constant region L, and which charges an interval between the surface being charged and a region M separated from the surface being charged and contiguous with the region L.

In stationary type contact chargers wherein a contact member used for charging is arranged at a predetermined position relative to the charge-receiving member having a moving surface, or wherein the contact member charges the surface of a charge-receiving member by making contact with the surface of the charge-receiving member which moves relative to the contact member, dirt readily accumulates in the aforesaid charging region M of the contact member with repeated use of the contact charger, thereby causing irregular charging, and ultimately causing image irregularities due to the irregular charging.

Thus, a need exists for a contact charger which eliminates the previously described disadvantages of conventional contact chargers.

SUMMARY OF THE INVENTION

The present invention provides an image forming apparatus of improved performance which includes a contact charger for charging a charge-receiving member. The present invention also provides a contact charger for an image forming apparatus having a contact-charging member which makes contact with and charges the surface of a charge-receiving member (carrier) that moves relative to the contact-charging member, wherein foreign matter which accumulates in the region of the contact-charging member separated from the charge-receiving member is eliminated by a discharge of the foreign matter during cleaning so as to prevent brush mark charging irregularities of the charge-receiving member, and allow excellent and stable charging over a long term with a high degree of reliability.

The invention improves the performance of an image forming apparatus having a photosensitive carrier, such as a photosensitive drum, for carrying an electrostatic latent image and a voltage source coupled to a contact-charging member for applying a voltage to the photosensitive carrier. The improvement includes a contact charger cleaner for changing a contact area between the contact-charging member and the photosensitive carrier to effect cleaning of the contact-charging member. This is accomplished, for example, by moving the contact-charging member from a charging position, where the contact-charging member contacts the photosensitive carrier at a first region, to a cleaning position, where the contact-charging member contacts the photosensitive carrier at a second region.

The cleaning of the contact-charging member may be enhanced by application of a voltage to the photosensitive carrier during cleaning. In some embodiments, the polarity of the voltage applied to the photosensitive carrier during cleaning of the contact-charging member is opposite to the polarity of the voltage applied to the carrier during formation of the electrostatic latent image.

The contact charger cleaner includes a moving device, or means, for moving at least a portion of the contact-charging member with respect to the photosensitive carrier.

In some embodiments, the moving device includes a support member having a threaded hole passing therethrough. The contact-charging member is attached to the support member. A screw shaft having external threads engage the threaded hole in the support member, and a motor applies a rotational force to the screw shaft to move the contact-charging member.

In another embodiment, the moving device includes a fixedly mounted support attached to the contact-charging member. A pressing member forces a free end of the contact-charging member into contact with the carrier during cleaning.

In still another embodiment, the moving device includes a support oscillatably supported on a body of the image forming apparatus, and attached to a first end of the contact-charging member. A pressing member forces a region of the contact-charging member which is not in contact with the photosensitive carrier during latent image formation into contact with the photosensitive carrier during cleaning of the contact-charging member, Other features and advantages of the invention may be realized from the drawings and detailed description of the invention that follows.

DETAILED DESCRIPTION OF THE PREFERRED EMBODIMENTS

The preferred embodiments of the present invention are described in detail hereinafter with respect to the accompanying drawings.

Figure 1:
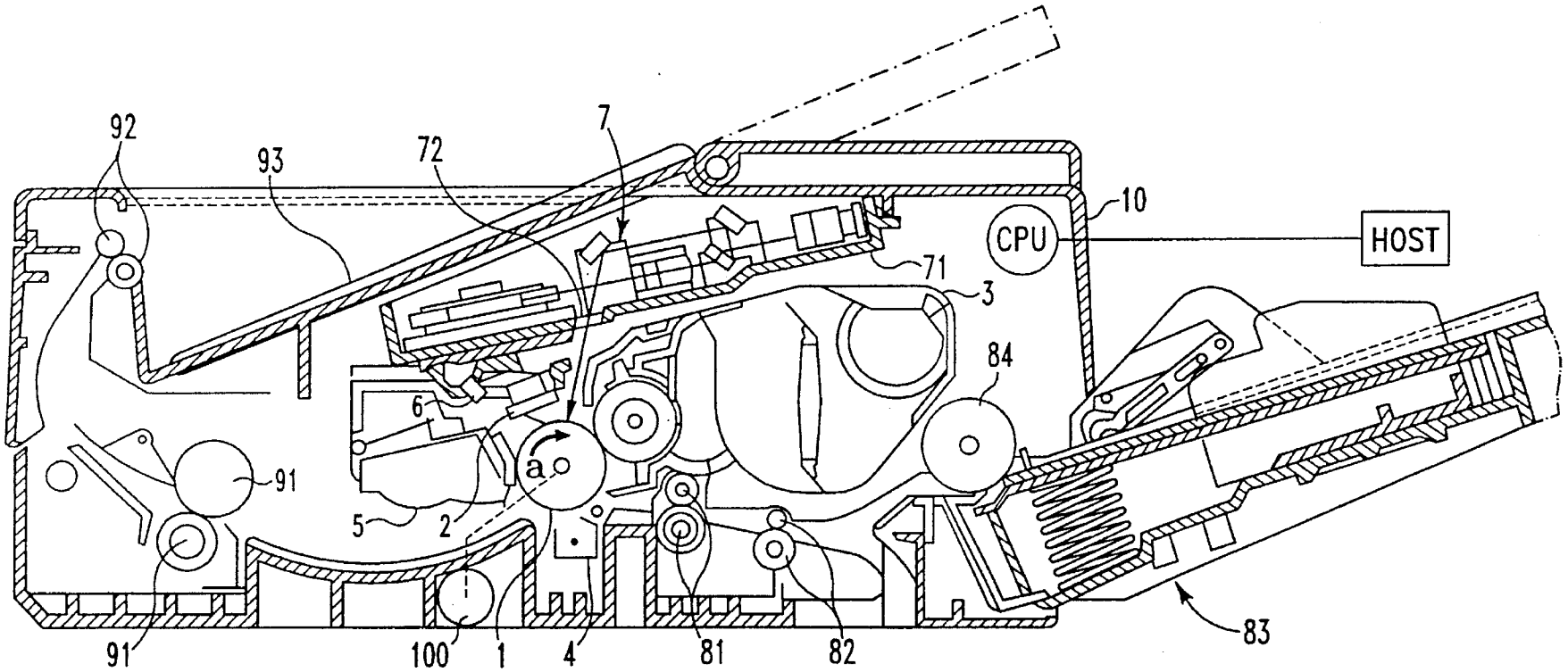
FIG. 1 briefly shows an example of a printer incorporating a contact charger of the present invention.

A printer in FIG. 1 is centrally provided with a photosensitive drum 1 as an electrostatic latent image carrying member or carrier (charge-receiving member), wherein drum 1 is rotatably driven in the direction of arrow a via main motor 100. Arranged sequentially around drum 1 are a charger 2, a developing unit 3, a transfer charger 4, a cleaner 5, and an eraser 6. Charger 2 is a contact charger.

An optical unit 7 is provided above photosensitive drum 1. Optical unit 7 includes a semiconductor laser generator disposed within housing 71, polygonal mirror, toroidal lens, half-mirror, spherical mirror, folding mirror, reflective mirror and the like. An exposure slit 72 is formed in the bottom of housing 71 from which image exposure light is emitted which passes between charger 2 and developing unit 3 so as to expose the surface of photosensitive drum 1.

Arranged sequentially around photosensitive drum 1 on the right side of the drawing are a pair of timing rollers 81, a pair of intermediate rollers 82, a paper supply cassette 83, and a feed roller 84 which confronts cassette 83. Arranged sequentially around photosensitive drum 1 on the left side of the drawing are a pair of fixing rollers 92 which are confronted by a discharge tray 93. The various aforesaid components are installed in a printer body 10.

According to the aforesaid printer, the surface of photosensitive drum 1 is uniformly charged to a predetermined potential by charger 2, and the charged region is optically exposed by image light from optical unit 7 to form an electrostatic latent image. The optical unit 7 exposes the charged region according to an image data from a host computer through a controller CPU. The thus formed electrostatic latent image is developed as a toner image by developing unit 3, and the developed toner image is moved to a transfer area opposite transfer charger 4.

On the other hand, a transfer sheet is fed from cassette 83 by feed roller 84, passes the pair of intermediate rollers 82, and arrives at the pair of timing rollers 81, then is transported to the transfer area synchronously with the aforesaid toner image formed on the surface of drum 1. The toner image on drum 1 is transferred onto the transfer sheet via the action of transfer charger 4, the transfer sheet arrives at the pair of fixing rollers 91, where the toner image is fixed onto the transfer sheet, and the transfer sheet is subsequently discharged to discharge tray 93 via the pair of discharge rollers 92.

After the toner image is transferred onto the transfer sheet, residual toner remaining on the surface of photosensitive drum 1 is removed by cleaning unit 5. The residual charge remaining on the surface of drum 1 is eliminated by eraser 6. The system speed of the printer (circumferential speed of drum 1) is 3.5 cm/sec, and developing unit 3 is a monocomponent contact developing device for reversal development.

Photosensitive drum 1 is a function-separated type organic photosensitive member using a negative charge and having a sensitivity relative to long wavelength light. The charge-generating layer is formed of a mixture of τ-type nonmetallic phthalocyanine and polyvinylbutyral resin having a thickness of about 0.4 μm, and the charge-transporting layer is formed of a mixture of hydrazone compound and polycarbonate resin as the main constituents having a thickness of about 18 μm. Electrostatic latent image carrying members applicable to the present invention, however, are not limited to the aforesaid.

In the present embodiment, the toner used in developing unit 3 is a negative charge type toner, formed of a mixture of main constituents including bis phenol A type polyester resin and carbon black kneaded, pulverized, and classified by well-known methods to achieve a mean particle size of 10 μm.

This toner is accommodated in developing unit 3, and development is accomplished with a developing bias of −300 V.

Although specific examples of contact charger 2 of the present invention in the aforesaid printer (see hereinafter Tables 1–6 including embodiments (Emb.) 1–30) are described below, first is described the method for evaluating brush mark irregularities caused by non-uniform potential on the surface of photosensitive drum charged by charger 2.

A 1 dot/4 dot halftone image was printed and image density fluctuation range in the width direction was measured using a Sakura densitometer (model PDA-65) made by Konica K. K. and image noise was ranked in the manner shown below.

| Image density fluctuation range | Evaluation rank |
|---|---|
| less than 0.05 | 5 (no problem) |
| 0.05 to 0.10 | 4 (slight oroblem) |
| 0.10 to 0.15 | 3 (practical limit) |
| 0.15 to 0.20 | 2 (below permitted level) |
| greater than 0.20 | 1 (below permitted level) |

Figure 2:
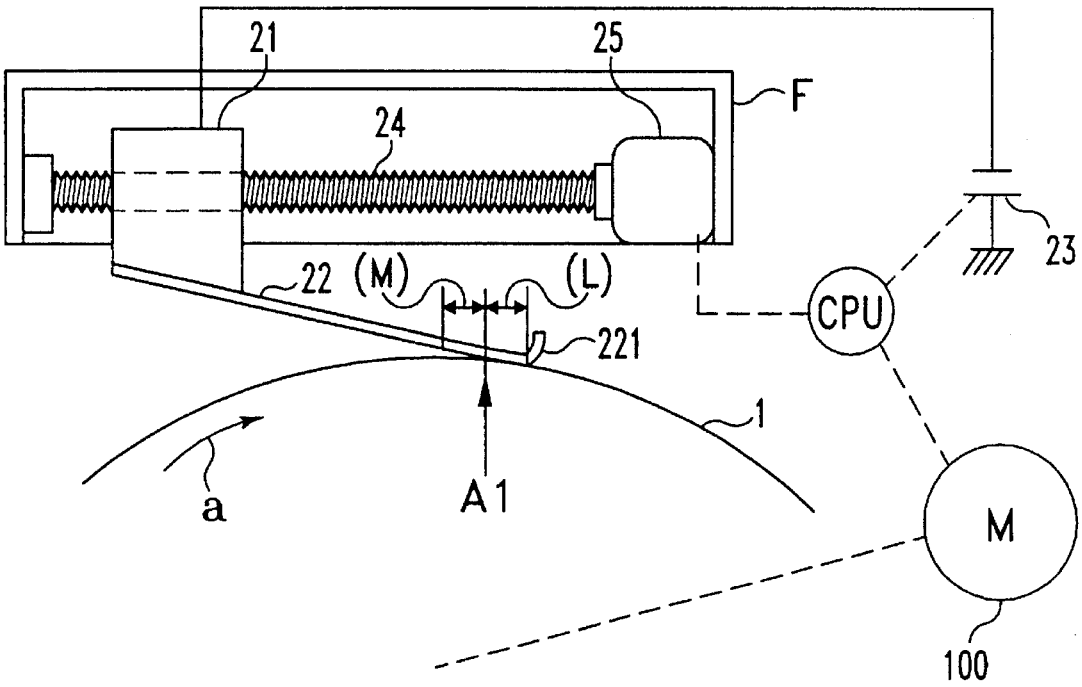
FIG. 2 shows the basic construction of a contact charger common to several embodiments of the invention during charging.
Figure 3:
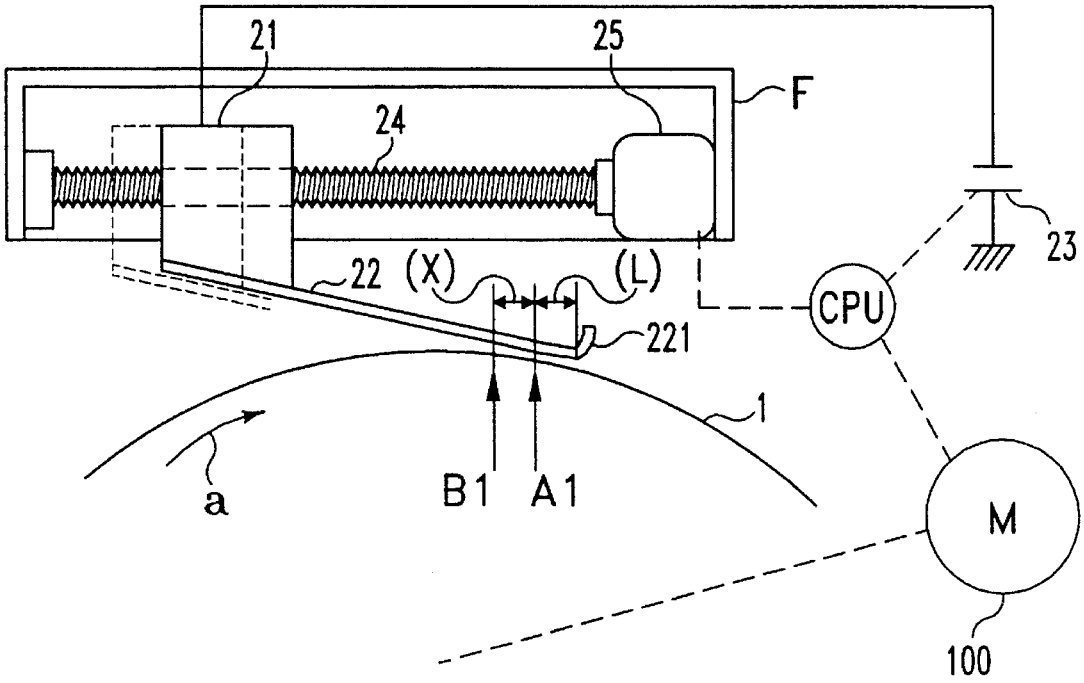
FIG. 3 shows the basic construction of the charger of FIG. 2 in the cleaning state of the contact-charging member.

Referring to Tables 1 and 2, each of the chargers in embodiments 1–12 have the basic construction shown in FIGS. 2 and 3.

As shown in FIGS. 2 and 3, a support member 21 and a film 22 extend in the axial direction of drum 1, and film 22 is adhered to support member 21 at a predetermined width by an electrically conductive adhesive material. An edge portion 221 on the free end of charging film 22 is bent in a direction away from photosensitive drum 1 forming an arc shape with a curvature of 0.5 mm. Film 22 is formed of carbon black dispersed in polyamide resin and has a thickness of 30 μm. A power source 23 is connected to support member 21 to supply a negative voltage for charging.

When a voltage is supplied by power source 23 to charging film 22 through support member 21 to charge the surface of photosensitive drum 1 for image formation, an electrostatic attraction force is generated between film 22 and photosensitive drum 1 such that film 22 is drawn out by a friction force resulting from the rotation of drum 1, and the leading edge L in front of contact point A1 between film 22 and drum 1 is adhered to drum 1 via the electrostatic attraction force, as shown in FIG. 2.

As shown in FIG. 2, film 22 contacts photosensitive drum 1 from a position A1 on the film to edge portion 221 on the free end of the film. The previously mentioned contact region L has a length of about 1 mm in a perpendicular direction relative to the rotational axis direction of the photosensitive drum.

In the state wherein a charging voltage is supplied from power source 23, a charge is generated in the space between photosensitive drum 1 and region M adjacent (contiguous) to contact region L, and the surface of photosensitive drum 1 is thereby charged.

In contrast, during cleaning, support member 21 and film 22 are moved downstream from their positions during charging by the surface movement in direction a of photosensitive drum 1 via the rotation of motor 25, such that the state of contact between film 22 and photosensitive drum 1 is set as shown in FIG. 3. At this time, film 22 is in contact with photosensitive drum 1 from a position B1 on the film to edge portion 221. That is, region M and region L are both in contact with photosensitive drum 1. When position A1 on the film is used as a reference, the length of the region to position B1 on the film in the aforesaid direction of movement is designated X. (In FIG. 3, the position of support member 21 during the charging process of FIG. 2 is indicated by the dashed line.)

When photosensitive drum 1 is rotated by printer main motor 100 in the aforesaid state of contact with charging film 22, the previously mentioned second region M is swept, and foreign matter adhering to film 22 is physically removed. Thus, accumulation of foreign matter on charging film 22 is prevented, thereby allowing uniform charging without brush mark charge irregularities from forming on photosensitive drum 1, such that excellent images are formed.

As can be readily understood from the aforesaid description, a drum driving means including main motor 100 for moving the surface of photosensitive drum 1 relative to film 22 is combined with a part of a contact-charging member cleaning means.

Figure 4:
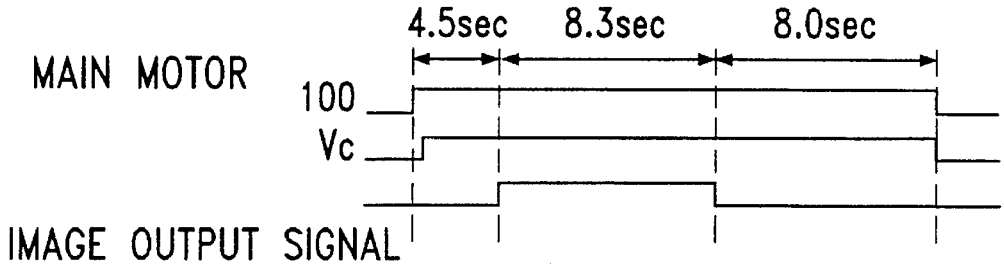
FIG. 4 is a timing chart showing the operation sequence relating to charger operation during image formation by the printer of FIG. 1.

Referring to Table 1, in embodiments 1–10 having the previously described basic construction, power source 23 applied a charging voltage of −1.3 kV to charging film 22 in the state shown in FIG. 2, and after printing 3,000 sheets of a character pattern comprising five percent of the total area as black color in the sequence described in FIG. 4, photosensitive drum 1 was rotated and film 22 was cleaned as in the state shown in FIG. 3. In the timing chart of FIG. 4, Vc is the applied voltage supplied to film 22.

Figure 15:
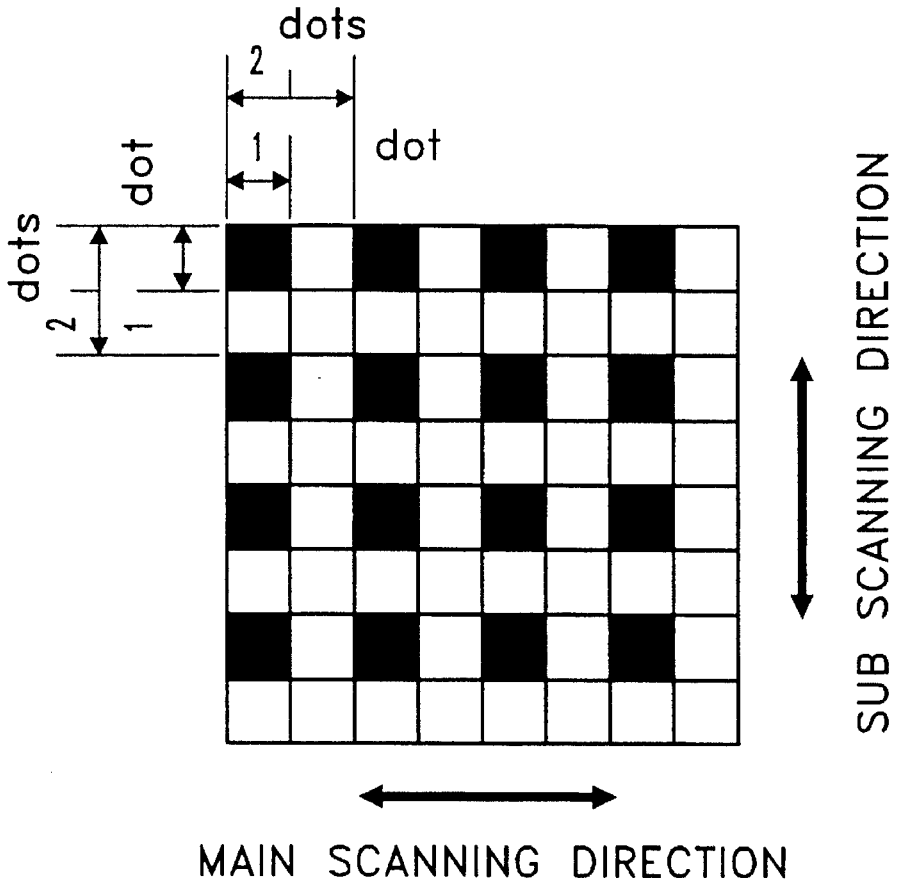
FIG. 15 is an illustration of an evaluation image for evaluating brush mark charging irregularities.
Figure 16:
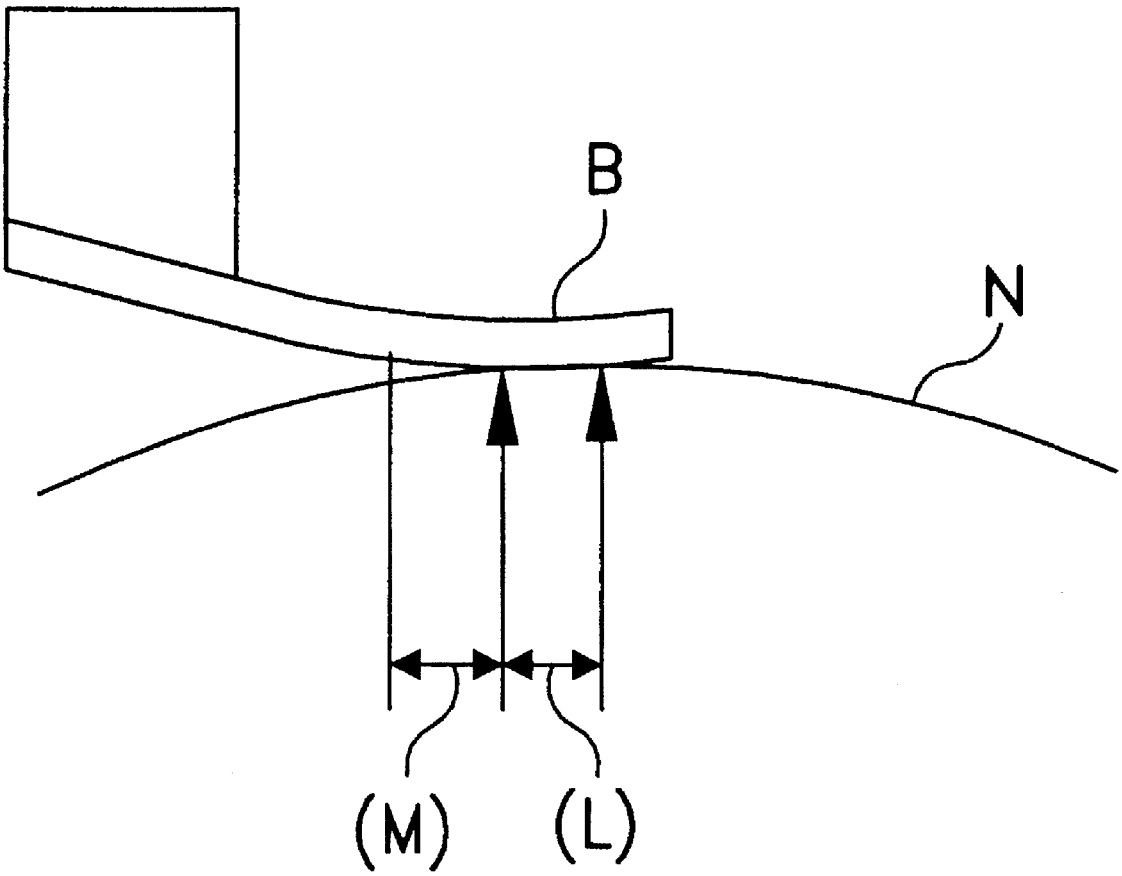
Fig. 16 (PRIOR ART)
FIG. 16 shows a conventional contact charger.

For cleaning evaluation, charging film 22 was returned to the state shown in FIG. 2 and the image shown in FIG. 15 was output. The cleaning results determined via the aforesaid image are shown in Table 1. In Table 1, Vc is the voltage applied to film 22 during cleaning, which was −1.5 kV in embodiments 1–8, and 0 V in embodiments 9 and 10. In each of the embodiments 1–10, the length X of the region from position A1 to B1 on film 22 in the movement direction are shown in Table 1.

Figure 5:
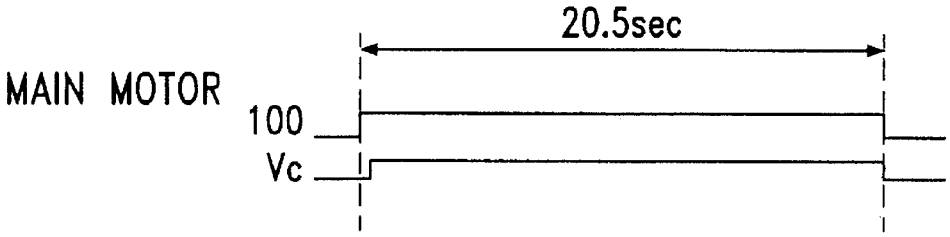
FIG. 5 is a timing chart showing part of one example of an operating sequence relating to charger operation of the contact-charging member of the contact charger during cleaning.
Figure 6:
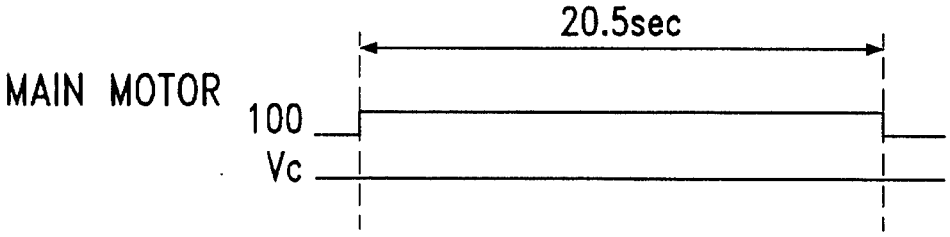
FIG. 6 is a timing chart showing part of one example of an operating sequence relating to charger operation of the contact-charging member of the contact charger during cleaning.

The sequence during cleaning of embodiments 1–8 is shown in FIG. 5, and the sequence during cleaning of embodiments 9 and 10 is shown in FIG. 6.

In FIG. 5, the controller CPU controls the main motor 100, the power source 23, optical unit 7 and the motor 25. The controller CPU drives the motor 25 and the power source 23 so that the film 22 is set in the state shown in FIG. 3 by driving the motor 25 and the power source 23 applies a cleaning voltage of −1.3 kV to the charging film 22. In the state, the main motor 100 drives the photosensitive drum 10 for a cleaning period of 20.5 sec which is sufficient for one rotation of the drum 10. If an image data is inputted into the CPU, the CPU inhibits the optical unit 7 from forming the electrostatic latent image during the cleaning period.

In FIG. 6, the controller CPU controls the main motor 100, the power source 23, optical unit 7 and the motor 25. The controller CPU drives the motor 25 and the power source 23 so that the film 22 is set in the state shown in FIG. 3 by driving the motor 25 and the power source 23 does not apply any cleaning voltage to the charging film 22. In the state, the main motor 100 drives the photosensitive drum 10 for a cleaning period of 20.5 sec which is sufficient for one rotation of the drum 10. If an image data is inputted into the CPU, the CPU inhibits the optical unit 7 from forming the electrostatic latent image during the cleaning period.

For reference examples (Ref. Ex.) 1 and 2, the aforesaid distance X was set at 0 mm during cleaning, i.e. film 22 was not moved, and film applied voltage Vc was set at −1.5 kV and 0 V, respectively. The cleaning results are shown in Table 1.

The results of Table 1 clearly show excellent images were obtained when film 22 is cleaned by bringing discharge region M contiguous to contact region L of film 22 during image formation into contact with photosensitive drum 1 during cleaning. Although cleaning effectiveness is particularly high when movement direction length X of region M is greater than 2 mm, an actual range of 2–3 mm is desirable since a drive force is required which is greater than the electrostatic attraction force generated when a voltage is applied to photosensitive drum 1 via film 22. The high degree of cleaning effectiveness via the action of an electrostatic attraction force was verified in embodiments 4–8 when cleaning was accomplished with a voltage applied to film 22, and a lower degree of cleaning effectiveness was verified in embodiments 9–10 when no voltage was applied to film 22.

Table 1 shows unsatisfactory cleaning results for reference examples 1 and 2.

TABLE 1

| | Distance X from A1 to B1 | Applied voltage Vc | Brush mark irregularity evaluation |
|---|---|---|---|
| Emb. 1 | 0.5 mm | −1.5 kV | 3 |
| Emb. 2 | 1.0 mm | −1.5 kV | 4 |
| Emb. 3 | 1.5 mm | −1.5 kV | 4 |
| Emb. 4 | 2.0 mm | −1.5 kV | 5 |
| Emb. 5 | 2.5 mm | −1.5 kV | 5 |
| Emb. 6 | 3.0 mm | −1.5 kV | 5 |
| Emb. 7 | 3.5 mm | −1.5 kV | 5 |
| Emb. 8 | 4.0 mm | −1.5 kV | 5 |
| Emb. 9 | 2.0 mm | 0 V | 3 |
| Emb. 10 | 3.0 mm | 0 V | 3 |
| Ref. Ex. 1 | 0.0 mm | −1.5 kV | 2 |
| Ref. Ex. 2 | 0.0 mm | 0 V | 2 |

Figure 7:
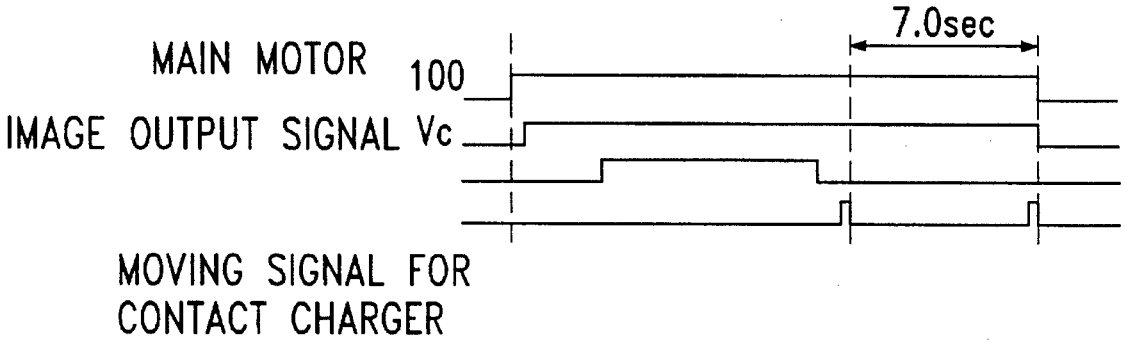
FIG. 7 is a timing chart showing part of another example of an operating sequence relating to charger operation of the contact-charging member of the contact charger during cleaning.

Referring now to Table 2, in embodiment 11, a voltage of −1.3 kV is applied to charging film 22, and as shown in the sequence of FIG. 7, the region from position A1 to B1 of film 22 contacts the surface of photosensitive drum 1 after an image is formed on each single sheet so as to achieve cleaning of film 22 via the post image formation end sequence. In embodiments 1–10 of Table 1, 5,000 sheets were printed using the same character pattern. The moving direction length X of the aforesaid region was set at 2.5 mm.

In embodiment 12, a voltage of −1.3 kV was applied to film 22. Five thousand sheets were printed in the same manner as in embodiment 11, wherein image formation was executed for ten consecutive sheets via the sequence of FIG. 4, and cleaning was accomplished via the end sequence of FIG. 7 after the tenth image formation sheet was output.

In reference example 3, the timing for ON/OFF switching of the main motor, and voltage application to film 22 are identical to that in the sequence of FIG. 4, but the 5,000 sheets were printed without the film movement for film cleaning shown in FIG. 3.

Image evaluation results after printing 5,000 sheets are shown in Table 2. The effectiveness of cleaning charging film 22 in the end sequence is shown in Table 2

TABLE 2

| | Brush mark irregularity evaluation |
|---|---|
| Emb. 11 | 5 |
| Emb. 12 | 4 |
| Ref. Ex. 3 | 1 |

In the previously described embodiments, a charging film comprising carbon black dispersed in polyamide resin was used; however, electrically conductive films comprised of other materials are usable insofar as the surface resistance of the film is within a range of about $10^3$ to $10^8\Omega$ −cm. Furthermore, excellent images can be obtained even when a toner comprising polyamide resin, fluororesin or the like and a material having excellent release characteristics are used, because printing is accomplished without toner adhesion at the contact position of the contact member and the charge-receiving member.

Figure 8:
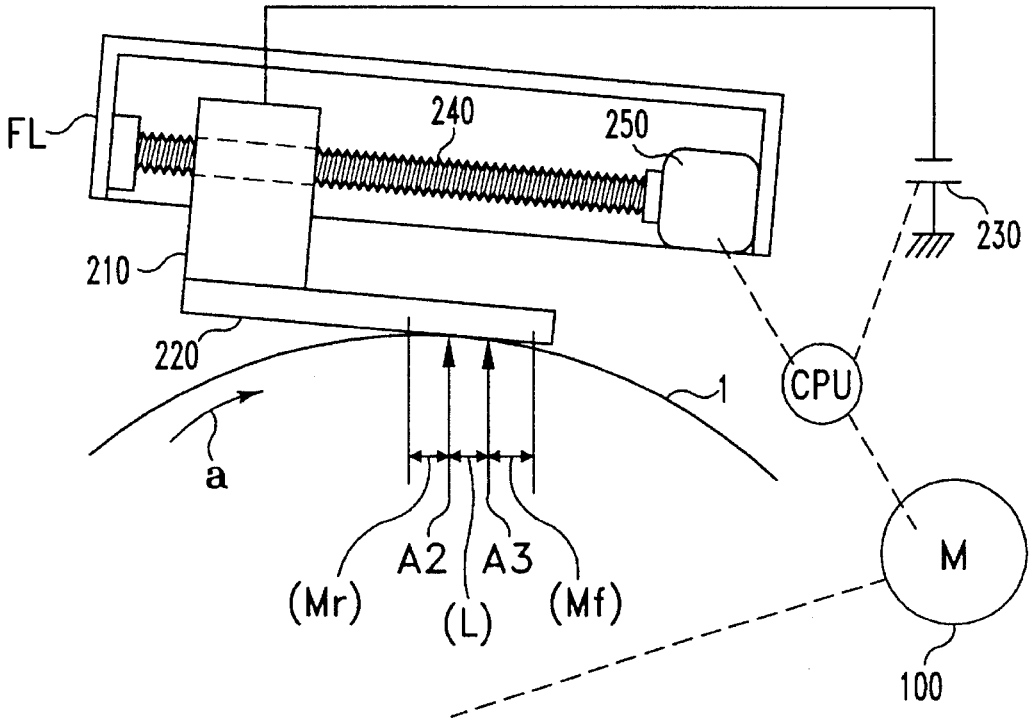
FIG. 8 shows the basic construction of a contact charger common to other embodiments of the present invention.
Figure 9:
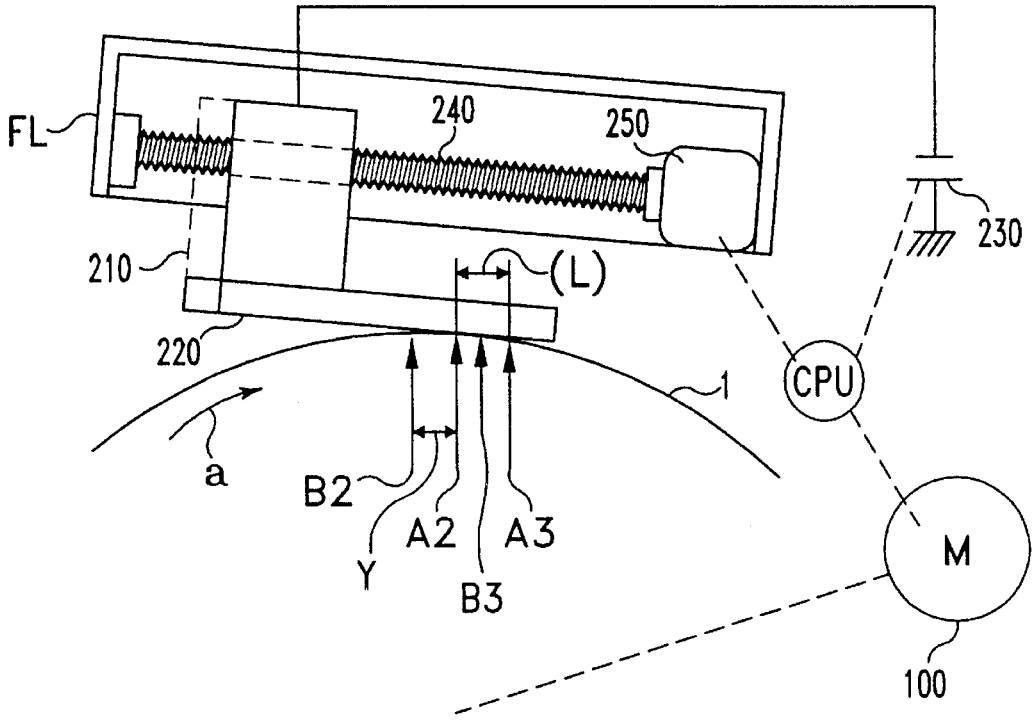
FIG. 9 shows the basic construction of the charger of FIG. 8 in the cleaning state of the contact-charging member.

Referring to Tables 3 and 4, embodiments 13–25 are modifications of the embodiments shown in FIGS. 2 and 3, and use contact chargers having the basic construction shown in FIGS. 8 and 9.

The chargers of FIGS. 8 and 9 are provided with a charging blade 220, and conductive support member 210 (an aluminum support member 210 in the present embodiment) for supporting blade 220. One end of blade 220 is attached to support member 210, and part of the free end of blade 220 contacts the surface of photosensitive drum 1. Power source 230 is connected to support member 210 to supply a negative voltage for charging.

Support member 210 is supported by frame FL so as to be reciprocally oscillatable in a direction perpendicular to the rotational axis of photosensitive drum 1 (hereinafter referred to as "movement direction"). Screw rod 240 engages support member 210, screw rod 240 being rotatably supported by frame FL, and rotatably driven by motor 250 capable of forward and reverse rotation and installed in frame FL.

Support member 21 and blade 220 extend in the axial direction of drum 1. Blade 220 is adhered to support member 210 with a predetermined width via an electrically conductive adhesive agent.

Blade 220 is a rubber blade with a thickness of 2 mm. Blade 220 is formed from carbon black dispersed in diene rubber, and is flexible along its entire length.

FIG. 8 shows the state wherein a voltage from power source 230 is applied to charging blade 220 through support member 210 to accomplish charging for image formation. In this state, the free end of blade 220 contacts the surface of photosensitive drum 1; due to the elastic force, blade 220 contacts photosensitive drum 1 in a uniform region, i.e. region L from position A2 to A3 on blade 220 as shown in FIG. 8. Of course, region Mr of support member 210 contiguous to the contact region L is separated from the surface of photosensitive drum 1, as well as at region Mf at the leading edge of blade 220. This separation occurs because blade 220 is not the film shown in FIGS. 2 and 3, and adhesion does not occur due to electrostatic force. The movement direction length X of contact region L is 1 mm.

In this state, a discharge is generated in the space between photosensitive drum 1 and the aforesaid regions (Mr, Mf) by the application of a voltage from power source 230, thereby charging the surface of photosensitive drum 1.

In contrast, during cleaning, support member 210 and blade 220 are moved downstream from their positions during charging in the surface movement direction a of photosensitive drum 1 via the rotation of motor 250, such that the state of contact between blade 220 and photosensitive drum 1 is set as shown in FIG. 9. At this time, blade 220 is in contact with photosensitive drum 1 from a position B2 to B3 on the blade; the movement distance length from position B2 to B3 is 1 mm. That is, region Mr and region L are both in contact with photosensitive drum 1. When position A2 on the blade is used as a reference, the distance to position B2 is designated Y. At this time, Y is positive when position B2 is on the reverse direction side of position A2 relative to the movement direction a of photosensitive drum 1, and Y is negative when on the movement direction side.

When photosensitive drum 1 is rotated by printer main motor 100 in the aforesaid state of contact with the charging blade, the previously mentioned second region from position B2 to B3 is swept, and foreign matter adhering to the film 22 is physically removed. Thus, accumulation of foreign matter on charging blade 220 is prevented, thereby allowing uniform charging without brush mark charge irregularities from forming on photosensitive drum 1, such that excellent images are formed.

As can be readily understood from the aforesaid description, the drum driving means including main motor 100 for moving the surface of photosensitive drum 1 relative to blade 220 is combined with a part of a contact-charging member cleaning means.

In embodiments 13–23 having the previously described basic construction, power source 230 applied a charging voltage of −1.3 kV to charging blade 220 in the state shown in FIG. 8, and after printing in the same manner as in embodiments 1–10, photosensitive drum 1 was rotated and blade 220 was cleaned as in the state shown in FIG. 9.

For cleaning evaluation, charging blade 220 was returned to the state shown in FIG. 8 and the image shown in FIG. 15 was output. The cleaning results determined via the aforesaid image are shown in Table 3. In Table 3, Vc is the voltage applied to blade 220 during cleaning.

In each of the embodiments 13–23, the length Y of the region from position A2 to B2 on blade 220 in the movement direction are shown in Table 3. In embodiments 13–20, voltage Vc was set at −1.3 kV, and in embodiments 21–23 voltage Vc was set at 0 V. In embodiment 20, Y was set at 2 mm just as in embodiment 16, and after cleaning, Y was set at −1.0 mm to clean the tip of the blade, and cleaning was accomplished with a voltage of −1.3 kV similarly applied to the blade.

The results of Table 3 clearly show excellent images were obtained when blade 220 is cleaned with or without the application of a voltage to the contact-charging member by bringing region Mr and Mf adjacent (contiguous) to contact region L of blade 220 during image formation into contact with photosensitive drum 1 even when the contact member is a stationary type contact member with no electrostatic attraction force as in blade 220. It is particularly desirable that the movement be such that movement direction length Y of the region from position A2 to B2 on the contact member is 1–3 mm. Effective cleaning is accomplished even when the charging member is moved as in cleaning region Mf in the movement direction relative to position A2 of the charging member.

Table 3 shows unsatisfactory cleaning results for reference examples 4 and 5 when blade 220 is not moved regardless of whether or not a voltage is applied to the blade.

TABLE 3

| | Distance X from A2 to B2 | Applied voltage Vc | Brush mark irregularity evaluation |
|---|---|---|---|
| Emb. 13 | 0.5 mm | −1.3 kV | 3 |
| Emb. 14 | 1.0 mm | −1.3 kV | 4 |
| Emb. 15 | 1.5 mm | −1.3 kV | 4 |
| Emb. 16 | 2.0 mm | −1.3 kV | 4 |
| Emb. 17 | 2.5 mm | −1.3 kV | 4 |
| Emb. 18 | 3.0 mm | −1.3 kV | 4 |
| Emb. 19 | 3.5 mm | −1.3 kV | 3 |
| Emb. 20 | 2.0 → 1.0 mm | −1.3 kV | 5 |
| Emb. 21 | 1.0 mm | 0 V | 4 |
| Emb. 22 | 2.0 mm | 0 V | 4 |
| Emb. 23 | 3.0 mm | 0 V | 4 |
| Ref. Ex. 4 | 0.0 mm | −1.5 kV | 1 |
| Ref. Ex. 5 | 0.0 mm | 0 V | 2 |

Referring to Table 4, in embodiment 24, a voltage of −1.3 kV is applied to charging blade 220, and as shown in the sequence of FIG. 7, the region from position A2 to B2 of blade 220 contacts the surface of photosensitive drum 1 after an image is formed on each single sheet so as to achieve cleaning of blade 220 via the post image formation end sequence. Five thousand sheets were printed using the same character pattern as in embodiments 1–10. The moving direction length Y of the aforesaid region was set at 2 mm.

In embodiment 25, a voltage of −1.3 kV was applied to blade 220. Five thousand sheets were printed, wherein image formation was executed for ten consecutive sheets via the sequence of FIG. 4, and cleaning was accomplished via the end sequence of FIG. 7 after the tenth image formation sheet was output.

In reference example 6, the timing for ON/OFF switching of the main motor, and voltage application to blade 220 are identical to that in the sequence of FIG. 4, but the 5,000 sheets were printed without the blade movement for blade cleaning.

Image evaluation results after printing 5,000 sheets are shown in Table 4. The effectiveness of cleaning charging blade 220 in the end sequence is shown in Table 4.

TABLE 4

| | Brush mark irregularity evaluation |
|---|---|
| Emb. 24 | 4 |
| Emb. 25 | 4 |
| Ref. Ex. 6 | 2 |

Referring to Table 5, in embodiments 26–28, a voltage of −1.3 kV was applied to blade 220, and after printing in the state shown in FIG. 8 in the same manner as in embodiments 13–23, photosensitive drum 1 was rotated to the state shown in FIG. 9 with the movement direction length Y of the contact region of blade 220 to drum 1 set at 2 mm. In embodiment 26, −500 V is applied to blade 220 during cleaning; in embodiment 27, 0 V is applied to blade 220 during cleaning; and in embodiment 28, +500 V is applied to blade 220 during cleaning. The drum drive time for cleaning in embodiments 1–10 and embodiments 13–23 was set at 20.5 seconds. In order to ascertain cleaning function over time, image evaluations were made for each 5 seconds of cleaning. Image evaluations were made with image output after a return to the state of FIG. 8 in the same manner as in embodiments 13–23. As can be understood from Table 5, the voltage applied to blade 220 set at a positive voltage during cleaning produced excellent cleaning results. This excellent cleaning result is believed to occur because positive charged toner accumulated on the blade due to the application of a negative voltage to blade 220 for image formation, and when a positive voltage was applied to the blade during cleaning, the positive charged toner accumulated on the blade was attracted to photosensitive drum 1 by the formed electric field. That is, when the polarity of the voltage applied to the contact-charging member during cleaning is the opposite polarity to the voltage applied thereto during image formation, superior effectiveness is obtained.

TABLE 5

| | Applied | Cleaning Time | | | |
|---|---|---|---|---|---|
| | Voltage Vc | 5 sec | 10 sec | 15 sec | 20 sec |
| Emb. 26 | −500 V | 3 | 3 | 4 | 4 |
| Emb. 27 | 0 V | 3 | 3 | 4 | 4 |
| Emb. 28 | +500 V | 4 | 4 | 4 | 4 |

Figure 10:
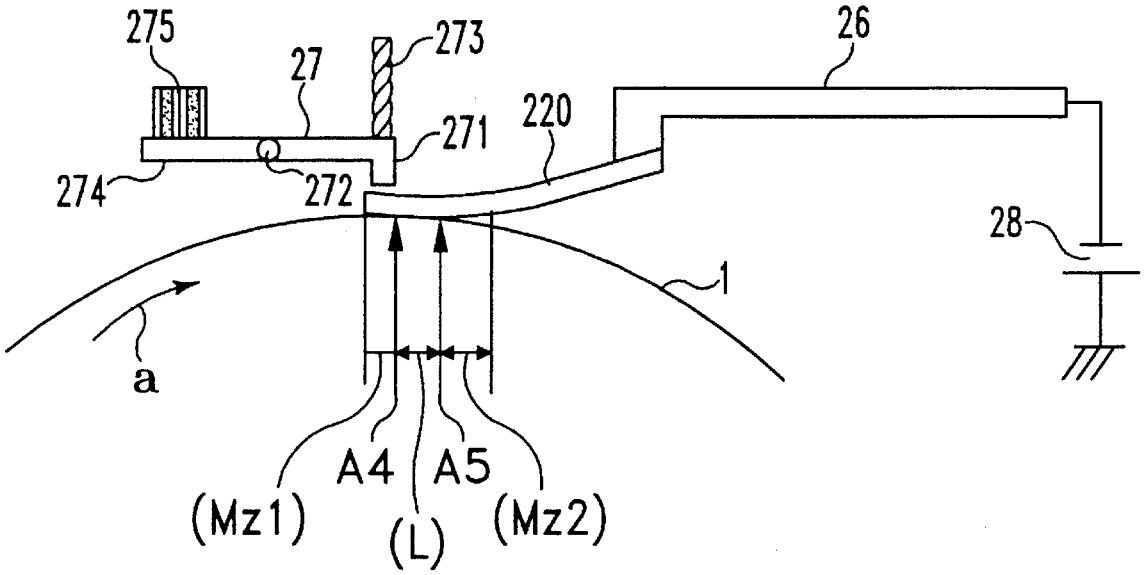
FIG. 10 shows the basic construction of a contact charger of other embodiments of the present invention during charging.
Figure 11:
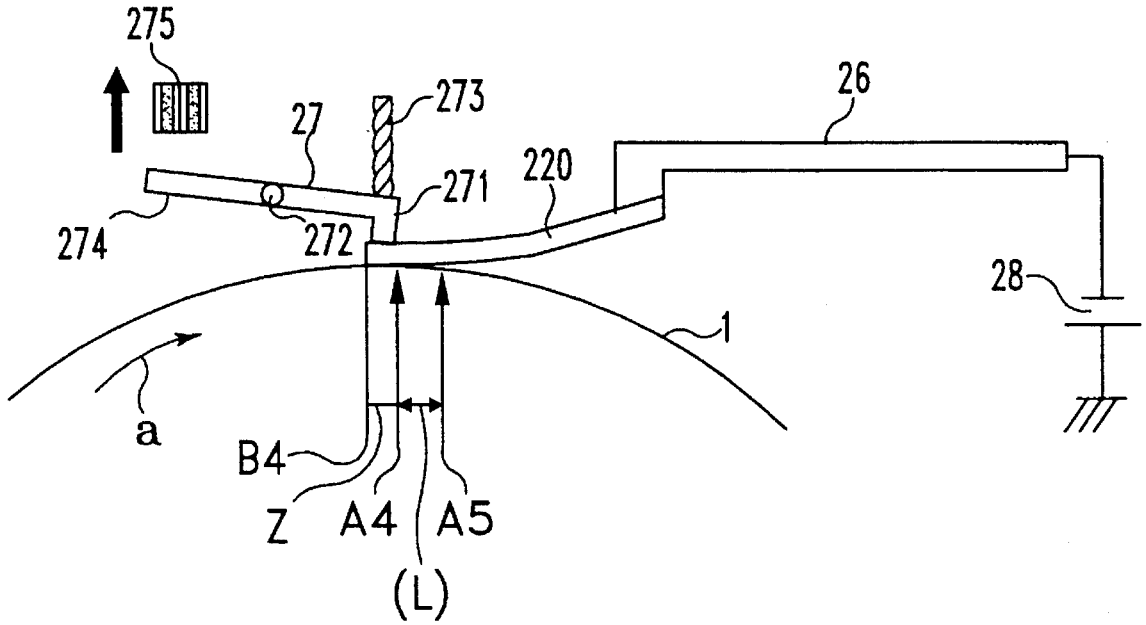
FIG. 11 shows the basic construction of the contact charger of FIG. 10 in the cleaning state.

Referring to Table 6, the charger of embodiment 29 is a modification having the construction essentially shown in FIGS. 10 and 11. The charger of embodiment 30 is a modification having the construction essentially shown in FIGS. 12 and 13.

These chargers of FIGS. 10–13 use a rubber blade identical to that used in embodiments 13–28, with the exception that blade 220 contacts photosensitive drum 1 from the side opposite the moving direction a of the surface of photosensitive drum 1. One end of blade 220 is attached to a conductive blade support member (an aluminum support member in the present embodiments), and a part of the free end of blade 220 contacts the surface of photosensitive drum 1.

In the chargers of FIGS. 10 and 11, one end of support member 26 is attached to the printer body (or a frame not shown in the drawing), and a leading edge portion 271 of lever 27 confronts the surface of the free end of blade 220. Lever 27 is oscillatably supported by the printer body (or a frame not shown in the drawing) via shaft 272 disposed in the midsection of lever 27, and the aforesaid leading edge portion 271 normally pushes blade 220 toward drum 1 via the force of spring 273. A weight 275 is provided to engage a trailing end 274 of lever 27, and can be raised via a drive means (not shown), for example, an electromotive drive such as a spring offset type solenoid.

FIG. 10 shows the state during charging. In this state, weight 275 is installed on lever 27, such that the leading end portion 271 of lever 27 is lifted against spring 273 and separated from blade 220. Blade 220 contacts the surface of photosensitive drum 1 in region L from position A4 to A5 on the blade. Regions Mz1 and Mz2 on the upstream side an downstream side from contact region L relative to movement direction a of the drum surface are separated from drum 1. The movement direction length of contact region L is 0.7 mm. In this state, a discharge is generated in the space between the drum surface and regions Mz1 and Mz2 contiguous to contact region L via the application of a charging voltage from power source 28 to blade 220, thereby charging the surface of photosensitive drum 1.

When the blade is cleaned, weight 275 is lifted from lever 27, with the result that the leading end 271 of the lever pushes the free end of blade 220 toward the surface of photosensitive drum 1 via the force of spring 273. At this time, blade 220 contacts drum 1 at the region from position B4 to A5 on the blade. When position A4 on the blade is used as a reference, the distance movement direction length Z from point A4 to B4 is 0.2 mm.

Figure 12:
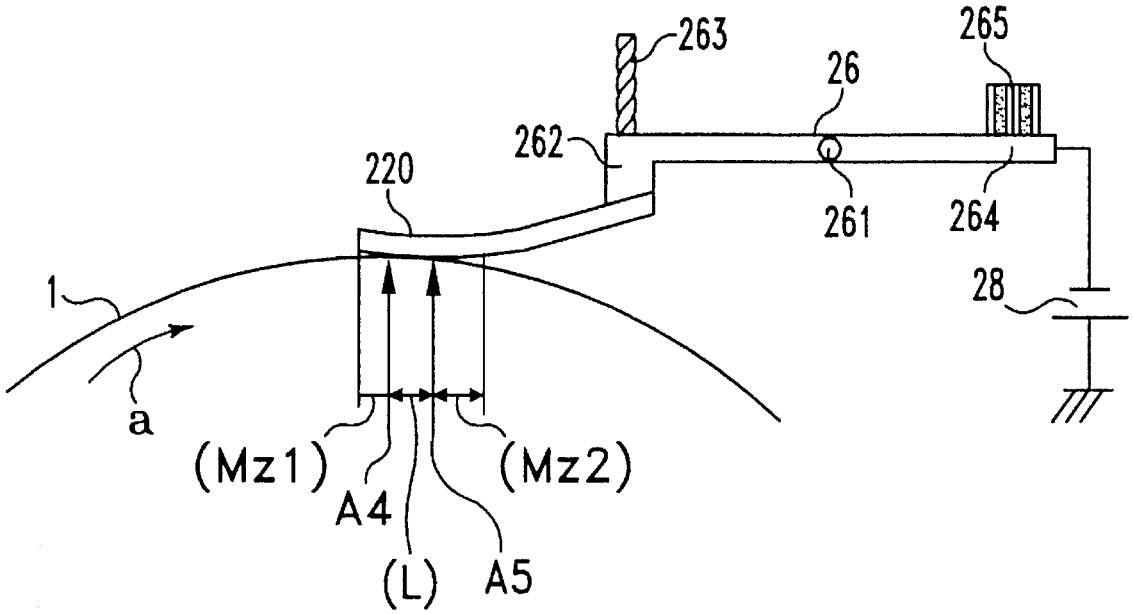
FIG. 12 shows the basic construction of a contact charger of other embodiments of the present invention.
Figure 13:
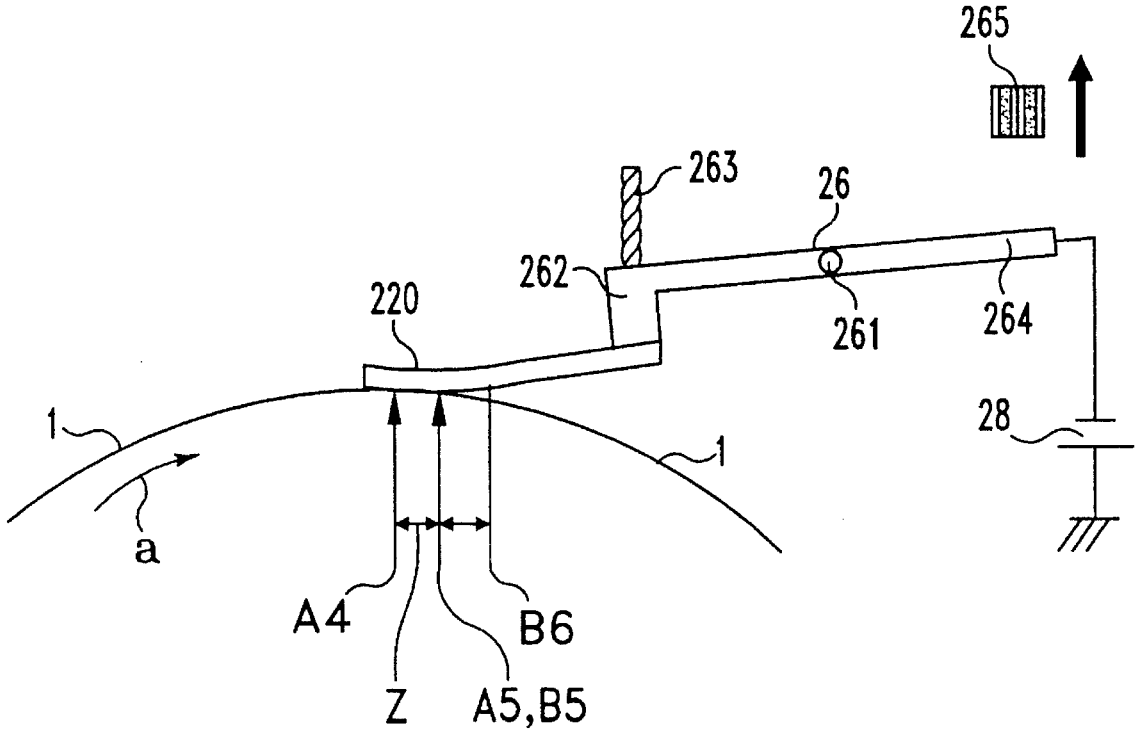
FIG. 13 shows the basic construction of the contact charger of FIG. 12 in the cleaning state of the contact-charging member.

In the chargers shown in FIGS. 12 and 13, support member 26 supporting blade 220 is oscillatably supported on the printer body or a frame (not shown in the drawing) via shaft 261 which is provided in the midsection of support member 26, such that leading end portion 262 of support member 26 which supports blade 220 is normally acted upon by a force exerted toward photosensitive drum 1 via spring 263. A weight 265 is provided to engage trailing end 264 of lever 26, and can be raised via a drive means (not shown) such as, for example, an electromotive drive such as a spring offset type solenoid.

FIG. 12 shows the state during charging. In this state, weight 265 is installed on support member 26, such that the leading end portion 262 of support member 26 is lifted against spring 263 and separated from blade 220. Blade 220 contacts the surface of photosensitive drum 1 in a uniform region, i.e. in region L from position A4 to A5 on the blade, via an elastic force. Regions Mz1 and Mz2 on the upstream side an downstream side, respectively, from contact region L relative to movement direction a of the drum surface are separated from drum 1. The movement direction length of contact region L is 0.7 mm. In this state, a discharge is generated in the space between the drum surface and regions Mz1 and Mz2 contiguous to contact region L via the application of a charging voltage from power source 28 to blade 220, thereby charging the surface of photosensitive drum 1.

As shown in FIG. 13, when the blade is cleaned, weight 265 is lifted from support member 26, with the result that the leading end 262 of the support member pushes the non-free end of blade 220 toward the surface of photosensitive drum 1 via the force of spring 263. At this time, blade 220 contacts drum 1 at the region from position B5 to B6 on the blade. The width of the contact nip in the movement direction is 0.7 mm. When position A4 on the blade is used as a reference, the movement direction length Z from point A4 to B5 is 0.7 mm. At this time, Z is positive when position B5 is in the opposite direction (upstream side) from position A4 in movement direction a of the drum, and Z is negative when position B5 is in the movement direction (downstream side). Accordingly, the value of Z is (−) 0.7 mm in FIG. 13.

In embodiments 29 and 30, a voltage of −1.3 kV was applied to blade 220. FIG. 10 shows the state during charging. In this state, weight 275 is installed on lever 27, such that the leading end portion 271 of lever 27 is lifted against spring 273 and separated from blade 220. Blade 220 contacts the surface of photosensitive drum 1 in region L from position A4 to A5 on the blade. Regions Mz1 and Mz2 on the upstream side and downstream side from contact region L relative to movement direction a of the drum surface are separated from drum 1. The movement direction length of contact region L is 0.7 mm. In this state, a discharge is generated in the space between the drum surface and regions Mz1 and Mz2 contiguous to contact region L via the application of a charging voltage from power source 28 to blade 220, thereby charging the surface of photosensitive drum 1.

When the blade is cleaned, weight 275 is lifted from lever 27, with the result that the leading end 271 of the lever pushes the free end of blade 220 toward the surface of photosensitive drum 1 via the force of spring 273. At this time, blade 220 contacts drum 1 at the region from position B4 to A5 on the blade. When position A4 on the blade is used as a reference, the distance movement direction length Z from point A4 to B4 is 0.2 mm.

Referring to Table 6, in embodiments 29 and 30 a voltage of −1.3 kV is applied to charging blade 220, and after printing in the same manner as described in embodiments 1–10, the blades were cleaned by rotating photosensitive drum 1 via the state shown in FIG. 11 in embodiment 29, and the state shown in FIG. 13 in embodiment 30. A voltage of −1.3 k was applied to blade 220 during cleaning. For cleaning evaluation, the image of FIG. 15 was output after returning blade 220 to the state shown in FIGS. 10 and 12. In reference example 7, photosensitive drum 1 was rotated to the state shown in FIG. 10 without actuating the blade. The results of these evaluations are shown in Table 6. As can be readily understood from Table 6, excellent cleaning and excellent images were obtained by regions Mz1 and Mz2 adjacent to the contact region which contacts the rotating photosensitive drum 1 during image formation even when the blade is charged as shown in FIGS. 10–13.

TABLE 6

| | Brush mark evaluation |
|---|---|
| Emb. 29 | 4 |
| Emb. 30 | 3 |
| Ref. Ex. 7 | 1 |

In general, the contact-charging member in the present invention includes a rubber blade, flat plate of various materials, film or the like (but is not specifically limited to such configurations). Charging of the surface of a charge-receiving member is accomplished by applying a voltage when the charging member is in contact with the surface of the charge-receiving member, whereby a contact region has a constant area. An example of a useful film type contact-charging member is a flexible film of a type identical to that disclosed in U.S. patent application Ser. No. 5,192,974, the specification of which is incorporated herein by reference.

Figure 14:
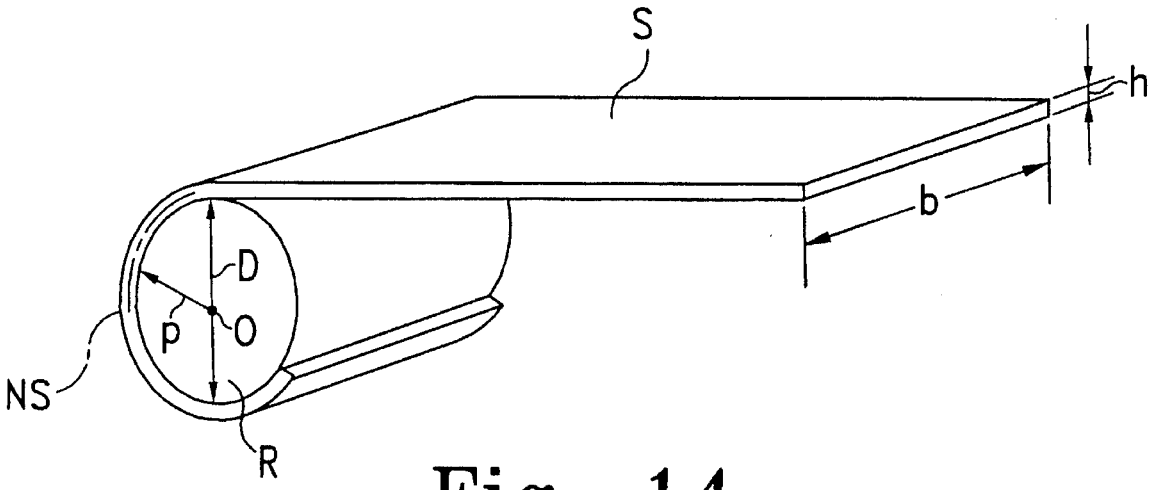
FIG. 14 is an illustration of a film usable as a contact-charging member.

More specifically, referring to FIG. 14, in order to achieve superior contact with the charge-receiving member, a contact-charging member S with a width b has a bending moment Mm required to wrap around a core rod R having a cylindrical cross section with a diameter D=1 cm will desirably has a bending moment $Mm \leqq 20$ g–cm, and ideally $Mm \leqq 10$ g–cm. The contact-charging member S also has mechanical strength (strength relative to breaking and tearing). The aforesaid bending moment Mm is defined as EI/p (where $I=bh^3/12$). E is the Young's modulus ($g/cm^2$) of film S, I is the second moment of area ($cm^4$) of film S, p is the distance between the center O of core rod R and intermediate surface NS of film S at the radius of curvature (cm) of film S, and h is the thickness of the film.

Examples of useful film materials include various types of conductive metallic materials, metal powder, metal whiskers, carbon powder, carbon fiber and like conductive materials dispersed in various types of synthetic resin materials subjected to conductivity surface processing and the like to obtain a film having conductivity or low electrical resistance (desirably $10^3$ to $10^8$ Ω –cm).

In addition to the contact-charging blades shown in FIGS. 2, 3 and 8–13, the contact-charging member may be a stationary non-rotating roller, belt or the like which contacts a charge-receiving member to accomplish a charging process.

According to the invention, the means for cleaning the contact-charging member may be either one that moves the surface region of the charge-receiving member in contact with the contact-charging member relative to the contact-charging member at a fixed position, or one that moves the contact-charging member relative to the charge-receiving member at a fixed position.

As shown in FIGS. 2, 3, 8 and 9, means for moving the contact-charging member may provide a support member for supporting the contact member, wherein a first region of the contact member contacts the surface of the charge-receiving member during charging and a second region separated from the surface of the charge-receiving member during charging, and a holder for supporting the support member so as to allow reciprocating movement with the second region in contact with the surface of the charge-receiving member during cleaning of the contact member. In this instance, the holder for holding the support member so as to allow reciprocating movement may be a holder frame provided on the body of the image forming apparatus. The means for achieving the reciprocating movement of the holder of the contact-charging member may be one that reciprocatingly moves the support member and contact member via the forward and reverse rotation of a screw rod which screws into the support member by a motor, as shown in FIGS. 2, 3, 8 and 9, or a solenoid which is connected to the support member so as to reciprocatingly move the support member. The aforesaid screw rod may be combined with all or part of the holder of the support member.

As shown in FIGS. 10 and 11, a means for moving the contact-charging member includes a member for exerting a force on the contact member so as to push a part (second region) of the contact member which is in a non-contact state during charging to the surface of the charge-receiving member during cleaning.

As shown in FIGS. 12 and 13, a means for moving the contact-charging member may provide a support member for supporting the contact member, a first region of the contact member which contacts the surface of the charge-receiving member during charging and a second region separated from the surface of the charge-receiving member during charging, and a holder for supporting the support member so as to allow oscillation of the support member such that the second region is in contact with the surface of the charge-receiving member during cleaning of the contact member, and means for oscillating the contact member support member on the holder. An example of an oscillation means provides that one end of the support member supporting the contact-charging member is normally forced toward the charge-receiving member by a spring, and is lifted against the spring force at the other end of the support member via a disconnectable weight.

Although the invention has been described with reference to preferred embodiments, workers skilled in the art will recognize that changes may be made in form and in detail without departing from the spirit and scope of the following claims.

What is claimed is:

1. An image forming apparatus comprising:

a carrier;

a contact-charging member;

a power source applying a voltage to the contact-charging member in order to charge the carrier;

an image forming device forming an electrostatic latent image by selectively discharging the charged carrier;

positioning means for selectively positioning the contact-charging member at a charging position where the contact-charging member contacts the carrier at a first region of the contact-charging member and at a cleaning position where the contact-charging member contacts the carrier at a second region of the contact-charging member; and a controller controlling the image forming device and the positioning means so that the image forming device forms the electrostatic latent image when the positioning means positions the contact-charging member at the charging position, and so that the image forming device is inhibited from forming the electrostatic latent image when the positioning means positions the contact-charging member at the cleaning position.

2. An image forming apparatus as claimed in claim 1, wherein the positioning means comprises:

a screw shaft;

a holder holding the contact-charging member and engaging the screw shaft; and a motor rotating the screw shaft, whereby the holder is moved along the screw shaft to move the contact-charging member between the charging position and the cleaning position.

3. An image forming apparatus as claimed in claim 1, wherein the positioning means comprises:

a shaft;

a holder holding the contact-charging member and engaging the shaft; and means for moving the holder with respect to the shaft.

4. An image forming apparatus as claimed in claim 1, wherein the positioning means comprises a pressing member, and wherein the contact-charging member is moved between the charging position and the cleaning position by a reciprocating movement of the pressing member.

5. In an image forming apparatus having a photosensitive carrier for carrying an electrostatic latent image and a voltage source coupled to a contact charger for applying a voltage to said photosensitive carrier, the improvement comprising a contact charger cleaner for changing a contact area between said contact charger and said photosensitive carrier to effect cleaning of said contact charger.

6. The apparatus of claim 5, wherein said voltage source applies a voltage to said photosensitive carrier during cleaning for enhancing the cleaning of said contact charger.

7. The apparatus of claim 6, wherein a polarity of the voltage applied to said photosensitive carrier during cleaning of said contact charger is opposite to a polarity of the voltage applied to the photosensitive carrier during formation of the electrostatic latent image.

8. The apparatus of claim 5, wherein said contact charger cleaner comprises means for moving at least a portion of said contact charger with respect to said photosensitive carrier.

9. The apparatus of claim 8, wherein said moving means comprises:

a support member having a threaded hole passing therethrough, said contact charger being attached to said support member;

a screw shaft having external threads engaging said threaded hole in said support member; and a motor for applying a rotational force to said screw shaft.

10. The apparatus of claim 8, wherein said moving means comprises:

a fixedly mounted support attached to said contact charger; and a pressing member for forcing a free end of said contact charger into contact with said photosensitive carrier during cleaning.

11. The apparatus of claim 8, wherein said moving means comprises:

a support oscillatably supported on a body of said image forming apparatus and attached to a first end of said contact charger; and a pressing member which forces a region of said contact charger which is not in contact with said photosensitive carrier during latent image formation into contact with said photosensitive carrier during cleaning of said contact charger.

12. A contact charger apparatus for charging a carrier for carrying an electrostatic latent image, said contact charger apparatus comprising:

a voltage source coupled to a contact charger for applying a voltage to said carrier; and a contact charger cleaner for changing a contact area between said contact charger and said carrier to effect cleaning of said contact charger.

13. The apparatus of claim 12, wherein said voltage source applies a voltage to said carrier during cleaning for enhancing the cleaning of said contact charger.

14. The apparatus of claim 13, wherein a polarity of the voltage applied to said carrier during cleaning of said contact charger is opposite to a polarity of the voltage applied the carrier during formation of the electrostatic latent image.

15. The apparatus of claim 12, wherein said contact charger cleaner comprises means for moving at least a portion of said contact charger with respect to said carrier.

16. The apparatus of claim 15, wherein said moving means comprises:

a support member having a threaded hole passing therethrough, said contact charger being attached to said support member;

a screw shaft having external threads engaging said threaded hole in said support member; and a motor for applying a rotational force to said screw shaft.

17. The apparatus of claim 15, wherein said moving means comprises:

a fixedly mounted support attached to said contact charger; and a pressing member for forcing a free end of said contact charger into contact with said carrier during cleaning.

18. The apparatus of claim 15, wherein said moving means comprises:

a support oscillatably supported on a body of an image forming apparatus and attached to a first end of said contact charger; and a pressing member which forces a region of said contact charger which is not in contact with said carrier during latent image formation into contact with said carrier during cleaning of said contact charger.

19. A charging device for charging a medium comprising:

a contact member which is contact with the medium;

means for moving the contact member from a charging position which is in contact with the medium in a first area to a cleaning position which is in contact with the medium in a second area; and means for applying a voltage to the contact member when the contact member is positioned in the charging position.

* * * * *